United States Patent [19]

Dumbaugh et al.

[11] 4,287,056

[45] Sep. 1, 1981

[54] SIFTER STROKE SCREEN

[75] Inventors: George D. Dumbaugh; Paul A. Wilson, both of Louisville, Ky.

[73] Assignee: Kinergy Corporation, Louisville, Ky.

[21] Appl. No.: 159,762

[22] Filed: Jun. 16, 1980

[51] Int. Cl.[3] ..... B07B 1/42

[52] U.S. Cl. ..... 209/332; 209/366.5; 74/61; 198/762; 198/770

[58] Field of Search ..... 209/331, 332, 365 R, 209/366, 366.5, 367, 365 B, 504; 74/61, 87; 198/752, 762, 770, 766

[56] References Cited

U.S. PATENT DOCUMENTS

| | | | |
|---|---|---|---|
| 1,141,660 | 6/1915 | Simpson | 209/366 |
| 2,358,876 | 9/1944 | Overstrom | 209/504 X |
| 3,251,457 | 5/1966 | Dumbaugh | 198/762 |
| 3,314,539 | 4/1967 | Hitchman | 209/332 X |

FOREIGN PATENT DOCUMENTS

| | | | |
|---|---|---|---|
| 2824550 | 12/1978 | Fed. Rep. of Germany | 209/365 B |

*Primary Examiner*—Ralph J. Hill
*Attorney, Agent, or Firm*—McWilliams, Mann & Zummer

[57] ABSTRACT

The invention relates to a flat stroke sifter screen having a vibratory excitor mounted at the inlet end and drive springs at the outlet end with a counterbalancing member having a tuning plate and stabilizers for the counterbalance, whereby the lateral vibratory action of the sifter is in the form of an elliptical motion adjacent the inlet end and a substantially straight back and forth, or axial motion is obtained adjacent the discharge end.

9 Claims, 3 Drawing Figures

SIFTER STROKE SCREEN

BACKGROUND OF THE INVENTION

Heretofore, screening devices have been provided which operated generally horizontally but with a strictly gyratory motion to distribute the product over the entire screen surface and some devices included bouncing balls, or the like, which were intended to prevent plugging of the screen. The balls were caused to bounce against the screen by the motion of the machine. These machines primarily comprised devices which relied upon brute force to achieve their purpose and consequently consumed more power and were expensive to operate.

To change the "stroke" of such prior machines it was necessary to deenergize the machine and the rotating eccentric weights then altered to modify the stroke, whereas customers wanted a low power consuming machine having a flat stroke screen which was readily adjustable as to the stroke and the frequency control. Such conventional screening apparatus utilized single power means and the component input to the screen resulted in similar stroke actions.

SUMMARY OF THE INVENTION

The present invention provides a vibratory flat sifter stroke screen having a squirrel cage driving motor to provide readily adjustable stroke and frequency of the sifter by varying the voltage to the motor. U.S. Pat. No. 3,251,457 of May 17, 1966 discloses a Method And Apparatus For Driving Vibrating Devices which utilizes a squirrel cage motor and autotransformer for varying the voltage of the motor. The sifter screen installation includes drive springs which produce a large part of the input force while the vibratory excitor driven by the motor provides the excitation energy. The motor and vibratory excitor are mounted adjacent to the inlet end of the sifter and the drive springs are mounted adjacent to the outlet end so that a generally rotary, or elliptical motion of the sifter screen is obtained in the area of the sifter near the inlet end and this motion is translated into a straight back and forth motion axially of the longitudinal center line of the sifter near the discharge end of the sifter and this "stroke" action of the machine is substantially horizontal, or flat.

The drive springs comprise steel coil springs and include an excitor member secured thereto which during operation acts as a counterbalancing mass for the coil springs. Importantly, the drive spring and excitor assembly includes stabilizers in the form of flat bar type springs disposed vertically and mounted at their lower ends on a base structure upon which the sifter screen assembly is mounted. The stabilizer springs are secured at their upper ends to the drive spring excitor assembly and act to guide the excitor mass which otherwise would project in free space extending outwardly from the drive springs. Addition of the flat bar type vertical stabilizing springs serves to control, or stabilize the action of the drive spring assembly and the sifter as a whole whereby to obtain the desired stroke action involving the elliptical motion adjacent the inlet end and the axial motion adjacent the outlet end of the sifter.

The sifter screen machine assembly is mounted on a base frame structure from which it is supported by means of four isolators which comprise steel coil springs. The isolators are disposed two of them at opposites of the sifter adjacent the outlet end thereof and the other two isolators are disposed at opposite sides of the machine at a point intermediate the length of the sifter in such manner that the sifter is free to vibrate in lateral and longitudinal directions as necessary.

OBJECTS OF THE INVENTION

The primary purpose of the invention embraces a flat stroke vibratory sifter screen having a generally elliptical stroke adjacent the inlet end of the sifter and a generally axial stroke longitudinally of the sifter adjacent its outlet end.

The principal object of the invention is to provide a flat stroke vibratory sifter screen supported on isolators for free vibratory motion laterally and longitudinally with excitor means adjacent the inlet end of the sifter and drive springs adjacent the outlet end.

An important object of the invention is the provision of a flat stroke vibratory sifter screen assembly having a rotary excitor adjacent the inlet end giving the sifter screen a generally rotary motion horizontally in this area and a drive spring assembly adjacent the outlet end which converts such rotary motion to an axial motion longitudinally of the sifter in the outlet area.

A further important object of the invention is to provide a drive spring assembly having an excitor counterbalancing the springs and vertical stabilizer springs connected with the drive spring assembly to guide the excitor mass and control the stroke action of the assembly.

Another object of the invention is the provision of a flat stroke vibratory sifter screen having a vibrator device at one end imparting lateral and longitudinal motion to the sifter and a drive spring at the opposite end of the sifter complementing the longitudinal motion of the vibrator device whereby the lateral motion diminishes from the one end to the opposite end where it becomes a longitudinal back and forth motion at the opposite end.

DESCRIPTION OF THE DRAWINGS

The foregoing and other and more specific objects of the invention are attained by the construction and arrangement illustrated in the accompanying drawings wherein.

DESCRIPTION OF PREFERRED EMBODIMENT

Figure 3:
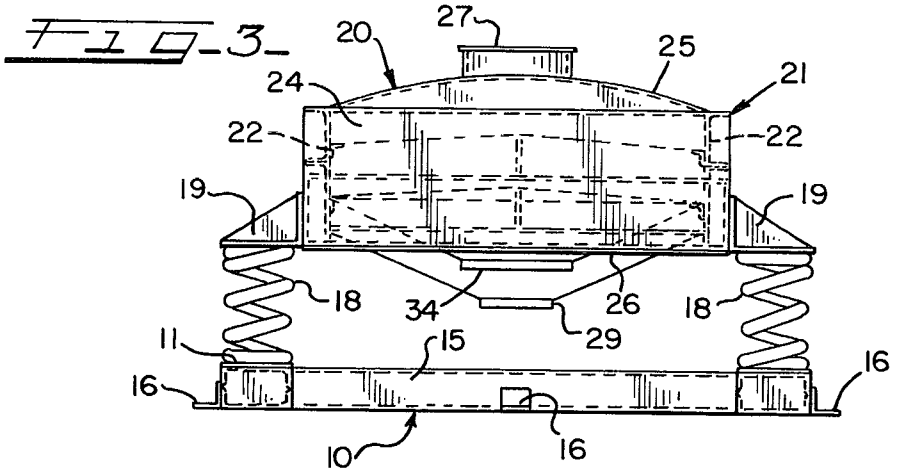
FIG. 3 is an end elevational view of the sifter screen assembly.
Figure 1:
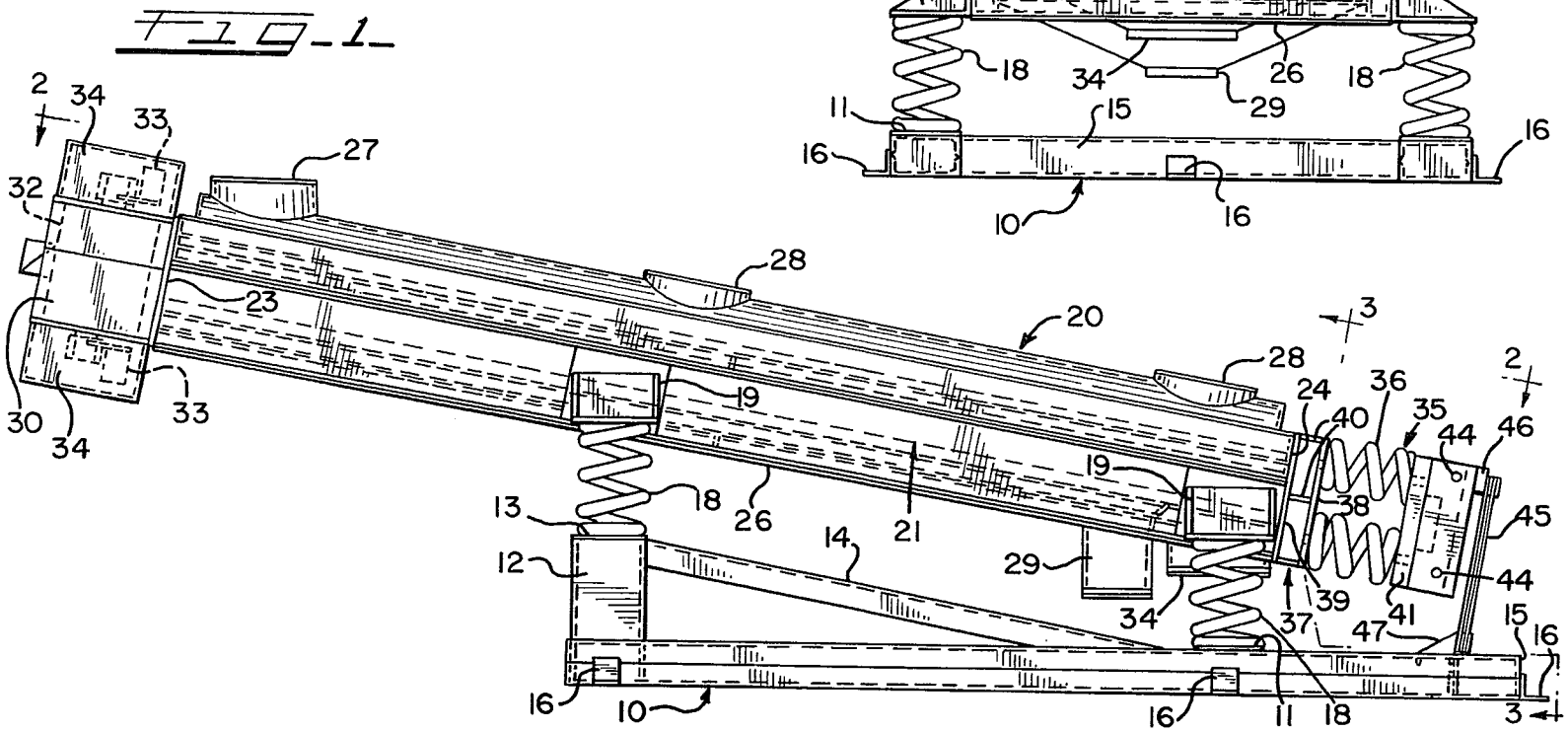
FIG. 1 is a side elevational view of a flat stroke vibratory sifter screen assembly as contemplated by this invention.
Figure 2:
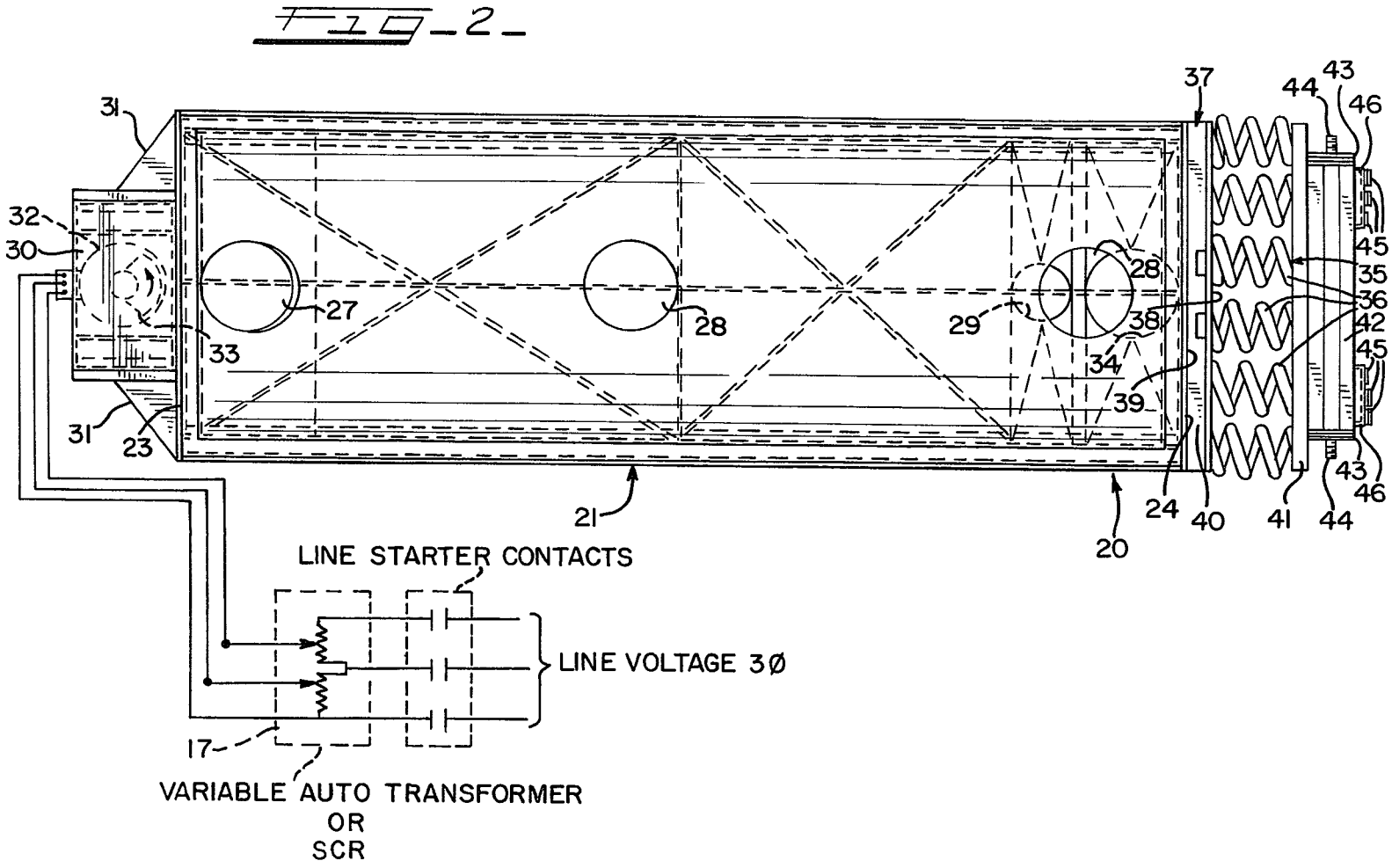
FIG. 2 is a top plan view of the sifter screen assembly.

The sifter screen assembly is mounted on a base frame structure which includes a rectangular frame 10 having isolator mounting pads 11 mounted one on each side rail of the frame adjacent an intermediate point of the length of the frame and a pair of laterally spaced upright struts 12 at one end of the base frame which support isolator mounting pads 13 at this end of the frame. The struts 12 are connected to the respective side rails of the base frame by diagonally disposed rails 14. All of these members, together with end rails 15, are assembled and secured together by welding and provide a rigid frame assembly that can be mounted on and secured to a base support by means of brackets 16 which can be secured to a floor or the like by means of bolts. This base frame provides a ready support for the sifter frame assembly at an inclined angle to provide the conveyor slope desired.

A sifter frame assembly 20 is provided with isolator support brackets 19 disposed and spaced to conform with the locations of the support pads 11 and 13 on the base frame and an isolator 18 is disposed between each of the pads 11 and 13 and the respectively associated brackets 19. The isolators 18 comprise steel coil springs which support the sifter assembly and enable that assembly to freely float on the base frame independently of any restraint so that when vibrated it is entirely free to move as controlled and directed by the devices hereinafter described.

The structure of the sifter screen assembly 20 includes a generally box like trough 21 having side walls 22, end walls 23 and 24, a bottom wall 26 and a top wall 25. The top wall 25 may be removable and has an inlet opening 27 and inspection ports 28 that can be opened for access to the interior of the sifter while the bottom wall 26 is provided with discharge outlets 29 and 34. The interior of the sifter may contain two screen decks with the top deck having larger openings than the lower deck for first screening coarsely on the upper deck which discharges through the outlet 34 and then fine screening on the lower deck from where the product drops onto the bottom of the conveying trough for movement through the discharge outlet 29. The screen structures are not specifically illustrated inasmuch as they do not form any part of this invention as claimed. The sifter thus is fully enclosed and accordingly is substantially dust free in operation.

The screen decks may be made of stainless steel, or rubber, or may comprise heated screen decks depending upon the type product to be sifted and typical of the various materials processed would be asbestos fiber, PVC, phosphate fertilizers, pellets, sugar, soybean flakes, detergents, cereals, meat scraps, wood chips including sliver cleaning, gluten meal, cottonseed meal, brewery tankage, corn, oats, salt, beef pulp, mash feed, poultry feed, or any product where a screening type separation is required. Where the conditions so indicate a number of hard rubber balls can be provided on the underside of the low mesh screen decks to prevent continual screen blinding which might otherwise occur.

At the end wall 23 adjacent to the inlet 27 a vibratory excitor 30 is rigidly mounted by means of brackets 31 and which includes a squirrel cage motor 32 having an eccentric weight 33 on each end of the drive shaft which is disposed vertically so that the eccentrics 33 rotate in horizontal planes. The eccentric weights are housed within enclosing shrouds 34 to avoid possible injury to attendants during operation of the sifter. As the eccentric weights 33 are rotated by the motor 32 they move in a direction tangential to the inlet so that the inlet end of the sifter is caused to move laterally but when the weights 33 are directed axially longitudinally of the sifter structure the sifter is caused to move axially.

The longitudinal movement of the sifter structure has the effect of exciting a drive spring assembly 35 at the discharge end of the sifter and which complements the action of the excitor 30 in the axial motion of the sifter. The drive assembly 35 comprises a battery of steel coil springs 36 that are secured directly to the end wall 24 of the sifter structure through the medium of a heavy plate structure 37 that includes a face plate 38, to which the springs are directly secured, a back plate 39 secured to the end wall 24 and bracing webs 40. The battery of springs 36 projects outwardly from the face plate 38 and are secured at their opposite ends to a heavy excitor plate structure 41 which includes a spaced plate 42 and end closure plates 43 through which bolts 44 extend to secure the massive assembly together as a unit. This mass, represented by the excitor plates 41, 42, 43, in operation acts to counterbalance the mass of the sifter trough structure through the springs 36.

The springs 36 and excitor plate assembly project outwardly from the end plate 38 on the sifter, but guide members for this assembly are provided in the form of vertically disposed flat bar type springs 45 disposed in groups of three adjacent respectively opposite side edges of the plate 42.

These flat bar type springs may be single ply or multiple ply, as desired and are secured to the plate 42 through the medium of brackets 46 to which they are bolted at their upper ends. At the lower end of the springs 45 they are secured to the base frame end member 15 through the medium of similar brackets 47, also by means of bolts. Thus, the excitor and spring assembly and the sifter structure are guided by the bar springs 45 which function as stabilizers and effectively control the actions of the battery of springs and the sifter structure to obtain the back and forth stroke of the sifter that is desirable at this end of the sifter.

By the use of the squirrel cage type of excitor motor 32 with adjustable voltage control as indicated at 17, the sifter unit becomes inherently adjustable with respect to both the stroke and the frequency simply by varying the voltage to the motor and this variable voltage can readily be obtained very simply by use of such a manually variable auto-transformer 17 and by this means a fully adjustable rate for the unit is easily provided.

Further, by means of this type of adjustable stroke and frequency control, the excitor 30 can be pulsed by means of a relatively high voltage to cause the sifter to shake at a higher speed and amplitude for a brief period and then, a lower voltage can be applied to the excitor 30 to obtain a lesser stroke and a lower speed of the sifter. This lesser stroke and speed might be the screening stroke and frequency normally used.

The particular stroking action of this sifter screen unit is important to the demonstrated successful use of this sifter arrangement and this action is provided by a combination of features not the least of which comprises the guidance and control afforded by the stabilizer flat bar springs 45 which are rigidly anchored at their bottom ends to the base frame 10 and fixedly connected at their upper ends to the drive spring assembly 35 and the excitor mass 41/42/43 to prevent, or restrict, lateral movement of the discharge end of the sifter 20 while fixing the vertical position of this end of the unit. Thus, the desired axial movement of the sifter unit at this end is effected and controlled.

The two mass design of the vibratory unit involving that of the sifter assembly 20 and the excitor assembly 41/42/43 renders the sifter much more readily and easily isolated on the springs 18 and of course, enabling the excitor assembly to act as a counterbalance for the main trough assembly 21, since this excitor mass projects in free space from steel coil drive spring assembly 35 and upon energizing the excitor 30 the vibrating action is actuated with a generally lateral motion developed by the rotary action which results in a circular, or elliptical, stroke action at the inlet end of the sifter.

By the complemental action of the drive springs 36 which are excited by the action of the excitor 30, this lateral motion is gradually diminished along the length of the sifter 21 to a straight back and forth stroke at the discharge end which is under the control of the flat bar stabilizer springs 45. The stroke action is flat but the sifter screen assembly is inclined downwardly from the inlet end to the discharge end so that the product being sifted shimmies down the screen decks in an action that has the highly beneficial effect of separating slivers from particles. As an example, straw slivers might be separated from sawdust particles where if the straw was pitched upwardly as would be the case with conventional conveyors using the typical conveying stroke, the straw slivers might become oriented vertically and fall in this position through the screen openings, whereas the sifter stroke action of this arrangement lends an advantage that prevents such slivers from being transported as indicated.

The stabilizers 45 give stability to the excitor mass 41/42/43 and thus provide for the elliptical stroke developed at the inlet end of the sifter to become a linear stroke at the discharge end and because the drive springs 36 produce most of the input force the vibratory excitor 30 needs only to provide the excitation energy, which reduces the power consumption needed to operate this unit to a minimum.

The sifter screen unit disclosed herein is approximately three feet six inches in width by approximately ten feet in screen length, inclined at an angle of ten degrees and the elliptical stroke length at the inlet end is approximately three eights of an inch at 855 CPM and three eights of an inch linearly at the discharge end. However, the unit is susceptible of construction in a wide range of sizes from twelve inches to twelve feet in width by as much as thirty feet in length. All of these units are made with the inherently adjustable stroke and frequency afforded the squirrel cage motor 32 which of course would be achieved by use of the variable autotransformer 17 herein before referred to.

In operation the laterally elliptical stroke at the inlet end of the sifter spreads the product material across the width of the screens and as is normal with a vibrating screen of this type the material is initially stratified with small particles going to the bottom of the mat depth and larger particles going to the top. This yields highly efficient screening with the small particles adjacent to the screen deck and as previously referred to, this type of screen action is very effective for separating elements of greater length than width from particles which may be more normal such as round, or similar configurations.

CONCLUSION

From the foregoing it will be seen that this sifter screen arrangement provides a unit that vibrates in a primarily lateral stroke at the intake end and having a linear stroke at the discharge end which is achieved by means of a rotary excitor unit mounted at the intake end with drive springs at the discharge end which are excited by the vibration of the excitor at the intake end and which are provided with an excitor mass functioning as a counterbalance with vertically disposed stabilizer springs connected between a base frame and the excitor mass to guide and control the drive spring and excitor mass to effect the linear motion at the discharge end of the sifter screen.

What is claimed is:

1. A vibratory sifter screen including a sifter trough and screen assembly mounted on spaced isolators supporting the assembly from a base structure, said assembly having an inlet end and a discharge end, an excitor mounted on the assembly adjacent the inlet end adapted to impart a generally lateral vibratory motion to the assembly at this end, and a drive spring and counterbalance mounted at the discharge end adapted to direct the vibratory motion in a linear direction adjacent to the discharge end.

2. A vibratory sifter screen assembly as set forth in claim 1 wherein said drive spring includes a battery of springs and said counterbalance comprises an excitor mass secured to the springs with the spring and excitor mass projecting outwardly from the end of the sifter screen assembly.

3. A vibratory sifter screen assembly as set forth in claim 2 wherein said drive springs and excitor mass are guided and controlled by a vertically disposed stabilizer spring secured to the mass and anchored to the base structure.

4. A vibratory sifter screen assembly as set forth in claim 3 wherein said stabilizer spring comprises a pair of flat bar type springs disposed respectively adjacent to each side of said mass.

5. A vibratory sifter screen assembly as set forth in claim 4 wherein said stabilizer springs each comprise a group of springs at the respective sides of the excitor mass and said isolators comprise vertically disposed steel coil springs freely floating the sifter screen assembly, said stabilizer springs controlling the drive spring and excitor mass to restrict lateral movement of the sifter screen assembly at the discharge end.

6. A vibratory sifter screen assembly as set forth in claim 5 wherein said excitor at the inlet end includes a rotary squirrel cage motor and said drive springs at the discharge end comprise steel coil springs.

7. A vibratory sifter screen assembly as set forth in claim 5 wherein said excitor mass includes a heavy plate secured to the driver springs, a spaced heavy plate disposed parallel to the first plate, and a pair of end closure plates at respectively opposite sides of the heavy plates with bolts extending through the end closure plates between the heavy plates.

8. A vibratory sifter screen assembly as set forth in claim 7 wherein said drive springs are secured to a heavy plate structure mounted on the discharge end of the sifter screen assembly.

9. In a vibratory sifter screen including a vibrating sifter trough mounted for vibrating freely, means for vibrating said trough incorporating a squirrel cage motor and an autotransformer for varying the voltage of the motor to vary the frequency and stroke of the vibrating sifter trough, the improvement comprising a stabilizer spring to guide and control the motion of the sifter trough, said stabilizer spring comprising a vertical flat bar spring, and a drive spring with a counterbalance mass disposed between the stabilizer spring and sifter trough.

* * * * *